United States Patent [19]

Leeds

[11] 4,190,254

[45] Feb. 26, 1980

[54] "DOUBLE-CHESS" GAME BOARD

[76] Inventor: Winthrop M. Leeds, 212 Overdale Rd., Pittsburgh, Pa. 15221

[21] Appl. No.: 709,919

[22] Filed: Jul. 29, 1976

[51] Int. Cl.[2] ..... A63F 3/02

[52] U.S. Cl. ..... 273/261

[58] Field of Search ..... 273/131, 134, 261, 260, 273/258

[56] References Cited

U.S. PATENT DOCUMENTS

| | | | |
|---|---|---|---|
| 511,306 | 12/1893 | Moore | 273/261 |
| 872,923 | 12/1907 | Ford | 273/261 |
| 3,359,003 | 12/1967 | Kass | 273/131 AD |
| 3,652,091 | 3/1972 | Zubrin | 273/261 |
| 3,840,237 | 10/1974 | Shkolnik | 273/261 |
| 3,866,918 | 2/1975 | Goldfarb et al. | 273/271 |
| 3,963,242 | 6/1976 | Treugut et al. | 273/131 KN |

FOREIGN PATENT DOCUMENTS

| | | | |
|---|---|---|---|
| 335792 | of 1903 | France | 273/261 |

*Primary Examiner*—Richard C. Pinkham
*Assistant Examiner*—R. Carl Moy
*Attorney, Agent, or Firm*—Willard R. Crout

[57] ABSTRACT

A game board for the play of partnership chess by four participants. The playing area of the board is 8-sided, being bounded by four straight sides alternated with four curved sides formed by quarter circles. A symmetrical checkered pattern of 120 four-sided and 8 five-sided playing spaces is provided on which four standard sets of 16 chess pieces are to be placed. In the preferred embodiment of this invention, an octagonal space or gate is located at the center of the board, with dotted lines establishing pairs of optional routes to either the right or left for those chess pieces permitted to make diagonal moves toward the board center.

1 Claim, 5 Drawing Figures

"DOUBLE-CHESS" GAME BOARD

BACKGROUND OF THE INVENTION

The well-known game of chess is played by two players with 16 special pieces moved by each contestant on a square checkered board having 64 square playing spaces in 8 rows of 8 squares each. The large variety of possible moves has provided a game of skill with a great deal of fascinating strategy. A number of inventors have attempted to design a four-player chess board, such as T. A. Castelano U.S. Pat. No. 3,433,482 or D. M. Isaac U.S. Pat. No. 3,844,563. However, the results were not very satisfactory since they altered the paths followed by the pieces or changed the number of pieces controlled by each player to such an extent that the strategy of play had little relation to the normal game of two-player chess.

Another inventor, Robert Zubrin U.S. Pat. No. 3,652,091, has created a hexagonal board that offers the possibility of three-player chess. Unfortunately, the provision of an odd number of players introduces several serious disadvantages. For instance, there is no clear-cut adversary relationship since a player at one moment appears to be allied with a second in attacking a third, while a little later he may find that both of the other players have turned a combined attack on himself. Also it becomes apparent that the frequently utilized maneuver in standard chess of exchanging pieces of equal rank cannot be used successfully in three-player chess since both of the players giving up pieces immediately become weaker with respect to the third player. Obviously the field is still open to the invention of a more satisfactory chess game in which more than two players may participate.

SUMMARY OF THE INVENTION

By virtue of this invention a novel game board is provided for the play of partnership chess by four participants. In each quarter of the board, at the front of which a standard set of 16 chess pieces is to be set up, there are 32 playing spaces divided into eight lanes of four spaces each. The four right hand lanes take curved paths to meet corresponding lanes from in front of the player on the right, while the four left hand lanes take curved paths to meet corresponding lanes from in front of the player on the left. Chess pieces are moved according to normal rules, with the addition of optional routes for those pieces permitted to make diagonal moves through the central area. In the preferred embodiment these optional routes are indicated by dotted lines between alternate faces of an octagonal space or gate located at the center of the board.

DESCRIPTION OF THE PREFERRED EMBODIMENTS

Figure 1:
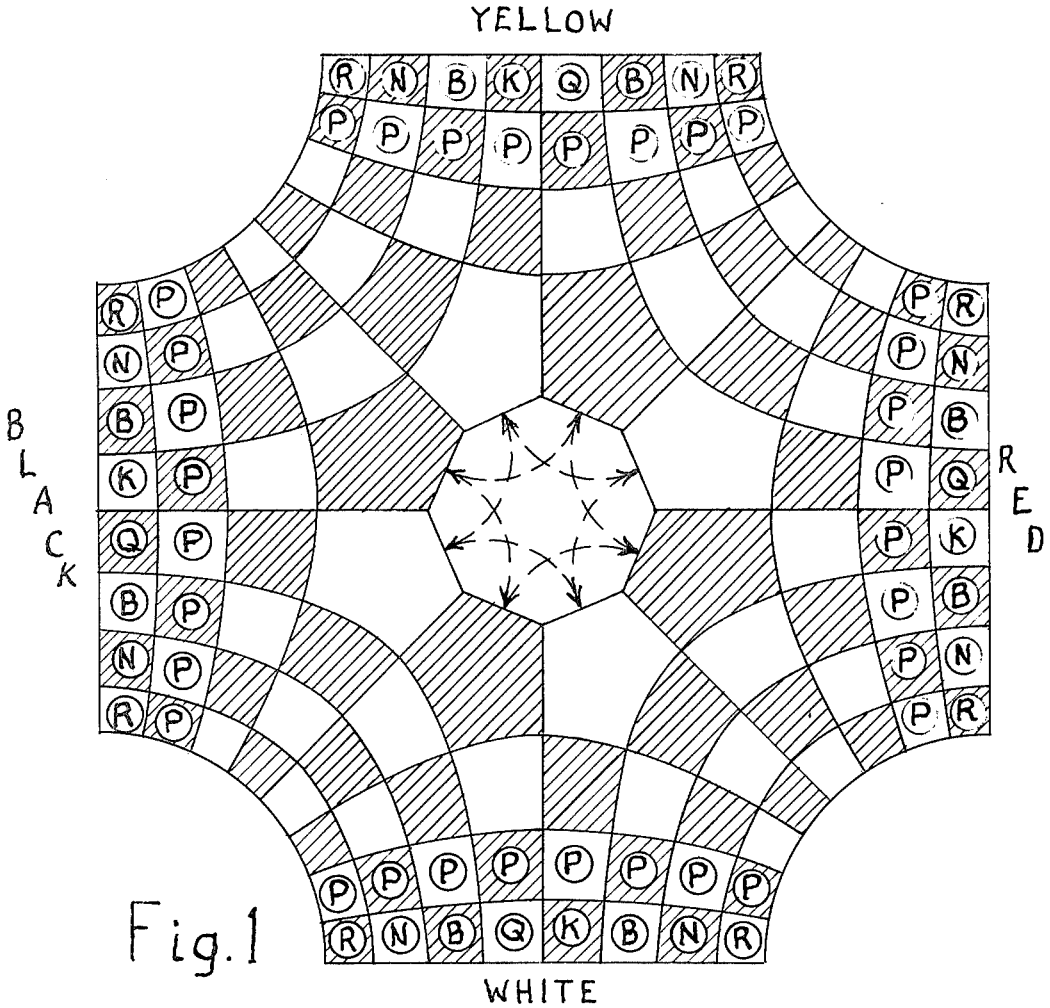
FIG. 1 is a plan view of a "Double-Chess" game board in accordance with this invention.

This invention is called a "Double-Chess" game board, providing suitable spaces to accommodate four players, each with the normal complement of 16 chess pieces, thus making possible partnership chess. FIG. 1 shows such a board representing the preferred embodiment of this invention. There are 128 playing spaces on the 8-sided board, just twice the number on a standard board for two players. The central octagonal space is used not as a playing space but as a gate, making possible extensions of the usual diagonal chess moves as will be described more in detail hereinafter. The playing spaces are colored alternately white and black to match the checkered appearance of a chess board, the right corner playing space in front of each player being white.

The chess pieces used by each player must be distinguishable in some way from those of the other players. Usually this differentiation will be by color such as, for instance, black and red pieces for one partnership while the other pair of players could use white and yellow pieces. If two duplicate sets of black and white pieces are to be used, the pieces of one set should have color marks or bands to distinguish them from the other set. Pieces are set up on the first two rows of playing spaces in front of each player in the normal manner as indicated in FIG. 1. The partners using the white and yellow pieces and sitting opposite to each other should each place their queen on the white square in the front row just to the left of the center line. Note that the partners using the black and red pieces should each place their queen on the black square just to the right of the center line.

It will be observed that the "Double-Chess" game board is designed so that all of the playing spaces, except the ring of 8 pentagonal spaces surrounding the center octagon, have four curved sides of such a shape that tangents drawn at each corner meet at right angles. A distinguishing feature of this chess board is that the four pawns to the right of the center line for any given player can advance from space to space in a curving direction until they come face-to-face with the left-hand four pawns of the opponent on the right, while the four pawns to the left of the center line can advance until they come face-to-face with the right-hand four pawns of the opponent on the left. It will be noted that there are 8 playing spaces in each of the 8 paths, starting from a player's first row and on to the eighth row, where "queening" of a pawn can take place as in regular chess.

Figure 2:
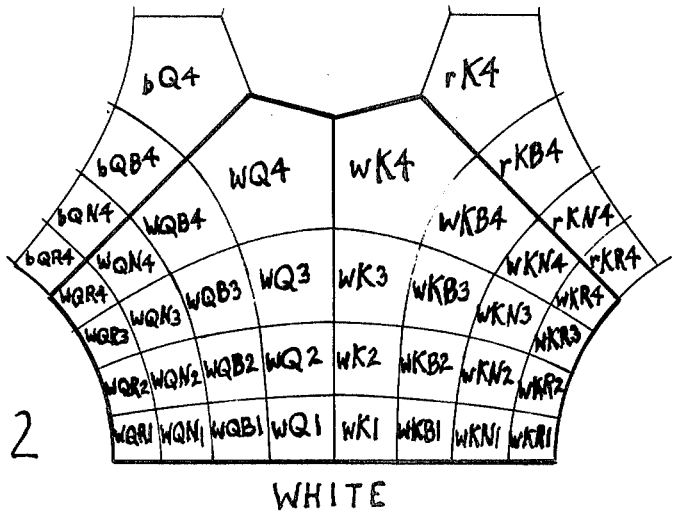
FIG. 2 is a partial plan view of the game board with each playing space marked with an identifying nomenclature.

For convenience in referring to specific playing spaces, the identifying nomenclature shown in FIG. 2 may be used. For instance, all of the 32 spaces in front of White bounded by the heavy lines are distinguished first by a small-case letter "w" for "white", followed by a "Q" or "K" for the Queen or King side, then a letter for the name of the piece on the first row starting position, such as a Rook (R) or Knight (N) or Bishop (B), and finally the row number 1, 2, 3 or 4. In front of the other players the space names would begin with "b", "y", or "r" for "black", "yellow", or "red" but otherwise follow the same procedure.

THE PLAY AND STRATEGY

It should not be necessary to describe chess piece movements and strategy that are substantially the same as in normal chess playing. However, there are some special moves and strategy that should be pointed out so that the method of play and unusual features of "Double-Chess" will be understood.

The objective of normal two-player chess is to checkmate the king of one's opponent. In "Double-Chess", one partnership can win only after one of the opponents' kings has been captured and removed from the board and then the second king checkmated. In regular chess, whenever a king is in check it must be defended or moved out of check. However, in "Double-Chess", as long as both kings of one side are on the board, one king may be left in check, giving the attacking party the option of either capturing the king or leaving it alone. For instance, if the attacking piece were a queen and it proceeded to capture a first king and then was in turn captured on the next move, such an exchange would not generally be advantageous. In fact, the exchange value of a first king is considered to be less than either a queen or a rook, so that the capture of a first king which would involve an exchange of pieces might better be made with a bishop, knight or pawn.

Figure 3:
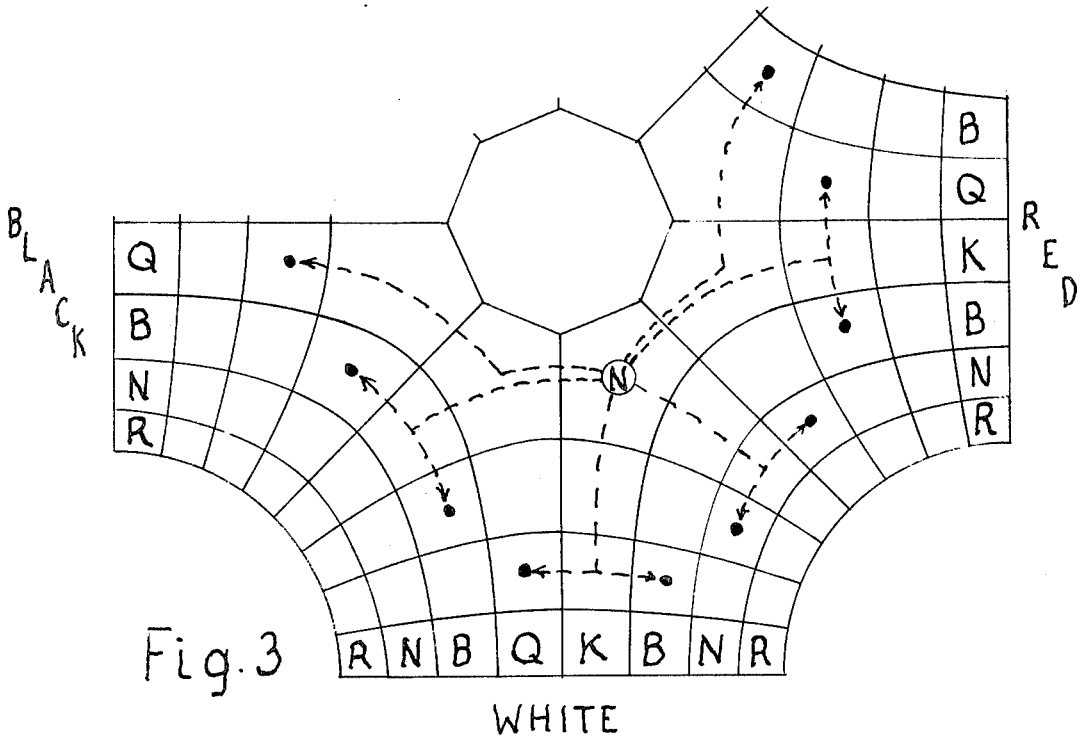
FIG. 3 is a partial plan view of the game board illustrating possible moves of the Knight in the play of "Double-Chess"

The movement of a rook, forward or backward, to the right or left, follows the normal rules, but the permitted moves of the knight on the "Double-Chess" game board are not always entirely obvious. The rule is for the knight to jump two spaces forward or backward or to one side or the other and then move an additional single space right or left. Using an alternate procedure of moving *one* space forward or backward or to one side or the other and then jump *two* spaces right or left, the knight would not arrive at any different spots in regular chess than those reached by the 8 different possible moves following the first procedure. However, from certain playing spaces in "Double-Chess" it is possible for the knight to make as many as 9 or 10 different moves if both of the above procedures are considered. For instance, a knight "N" on space wK4 shown in FIG. 3 may jump two spaces forward and one to the left to arrive at rQ3, or by moving one space to the left and then jumping two spaces forward the knight arrives at bQ3! Note the other 8 permitted moves to rQB4, rKB3, rKN4, wKN3, wKB2, wQ2, wQB3, and bQB4.

The most important addition to the possible moves of pieces in "Double-Chess" is the extension of diagonal moves of the queens and bishops whenever their route brings them up to one of the faces of the octagonal gate in the middle of the board. As indicated by the dotted lines shown in FIG. 1 these pieces may take either of two routes to continue on a diagonal as far as open spaces permit. For instance, if a queen is placed on the vacant board at wQR1 it may move on a diagonal up to the gate and then choose either a right turn and continue as far as rKR1, or the queen may turn left in the gate and continue all the way to bKR1. Naturally, the bishops also have the same freedom of choice whenever they enter the octagonal gate to emerge on either of two diagonals of the same color (white or black) as the diagonal traversed before entering.

Figure 4:
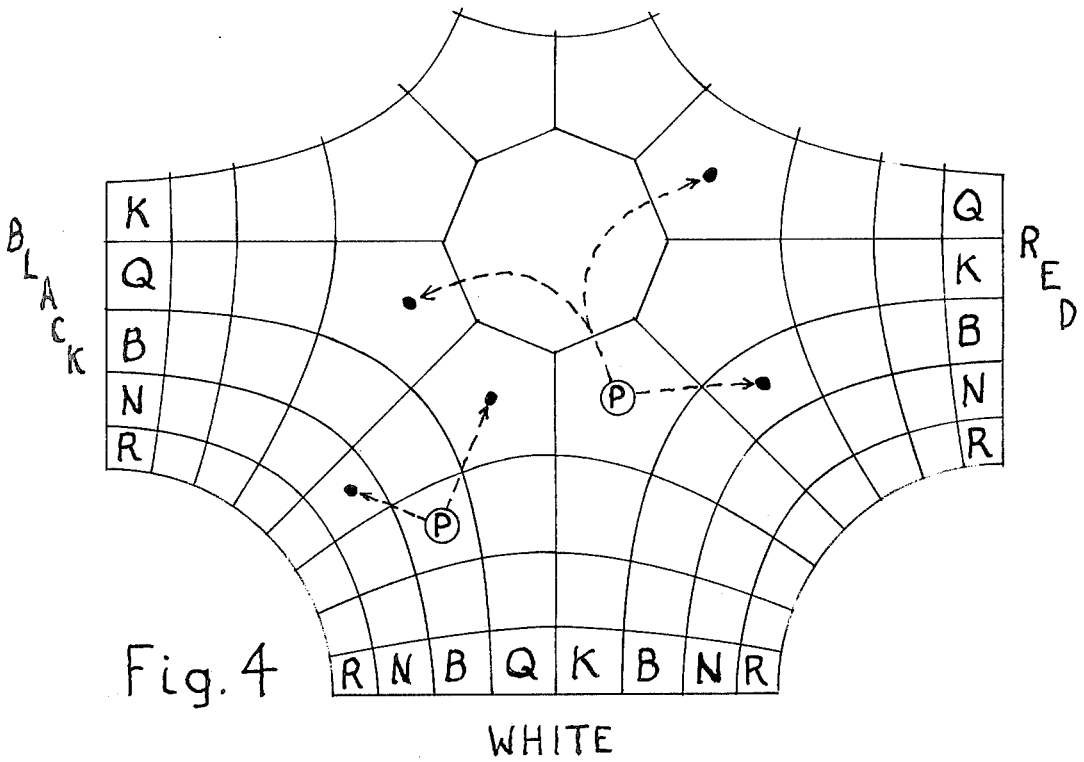
FIG. 4 is a partial plan view of the game board illustrating diagonal capture possibilities by a Pawn from different board locations.

Pawns normally can make a capture of an opposing piece only by a single-space diagonal move forward. For instance, the pawn shown in FIG. 4 at wQB3 could capture an opposing piece on either wQN4 or wQ4. However, there will be additional capture possibilities in "Double-Chess" whenever a pawn reaches one of the 8 pentagonal spaces surrounding the octagonal gate. Instead of threatening only the space diagonally ahead to the right, it can threaten two additional spaces through the gate. Thus, the pawn shown at wK4 threatens opposing pieces not only on rKB4 but also on rQ4 and bQ4. Any pawn has the normal privilege of "queening" whenever it reaches the eighth row away from home base.

The kings, of course, move in the usual way, one space only forward or backward, right or left, or along any diagonal. However, in "Double-Chess" a king has the choice of two diagonal moves through the octagonal gate if it should happen to be located on any one of the pentagonal spaces adjacent to the gate.

White always plays first and then play proceeds to Black on the left, then to Yellow and on clockwise to Red. Partners are not permitted to discuss strategy, so a player must try to figure out what his or her partner is planning and try to move in a way to support an attack on their opponents. Also, a player must watch the moves of both opponents carefully so as to be ready to defend not only his or her own pieces under attack but to defend if possible the partner's pieces as well. There are often opportunities for partners to join forces in attacking a weak position of one of the opponents. As in regular chess, the early part of the game is devoted to advancing pieces cautiously to advantageous positions from which an attack can be launched when the opportune moment arrives.

Figure 5:
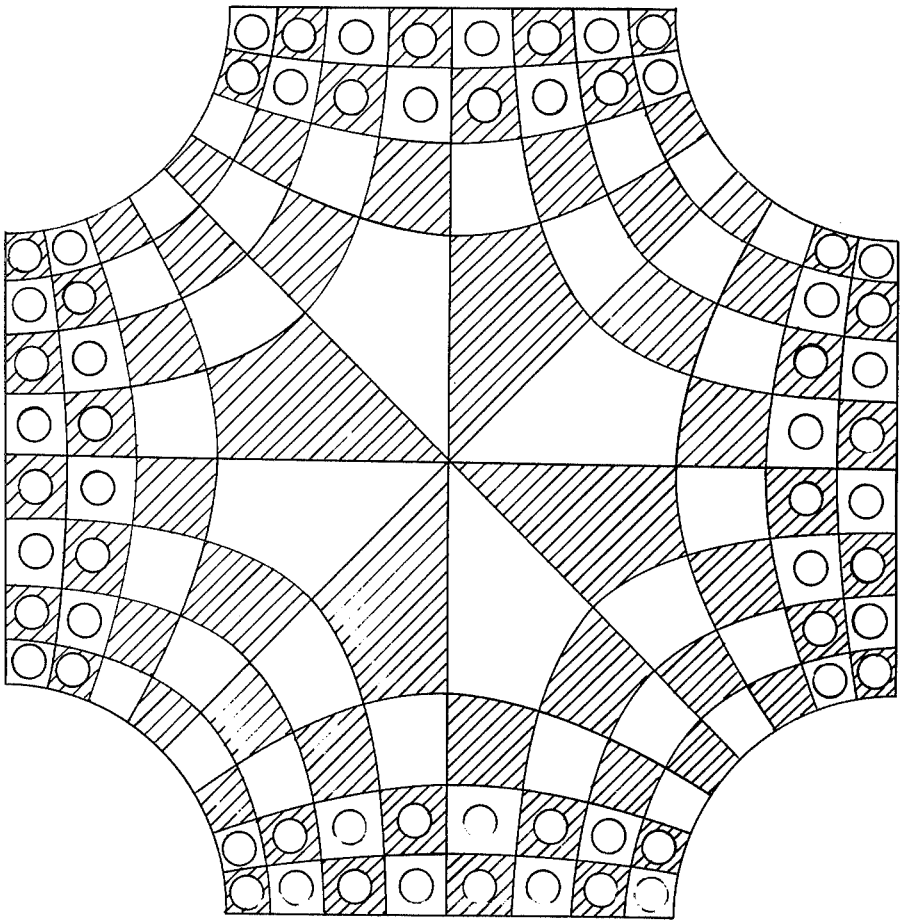
FIG. 5 is a plan view of another "Double-Chess" game board on which the central octagonal space or gate is omitted.

It is possible to play "Double-Chess" on a board without the octagonal gate, the boundary lines of the eight central spaces converging to the center point as shown in FIG. 5, provided that the choices in diagonal moves through the center are understood. However, the novel design of the octagonal gate in the preferred embodiment of this invention with optional routes for piece movement indicated by dotted lines is believed to be a very advantageous feature that makes the proper play of the game easier to understand.

Although the preferred design of the "Double-Chess" game board, shown in FIG. 1 and described above, consists of a novel pattern of 128 playing spaces within an 8-sided boundary printed on a generally square board, the use of alternate board shapes, such as octagonal or circular boards, but with substantially the same pattern of playing spaces printed thereon would still be included within the scope of this invention. Also, a different choice of colors for the pieces than those specified herein or the use of any other means for distinguishing the four sets of 16 chess pieces when utilized for playing "Double-Chess" does not constitute a departure from the intent of this invention.

Having thus described the invention and illustrated its use, what is claimed as new and is desired to be secured by Letters Patent is:

1. A chess game board having an 8-sided peripheral configuration consisting of four straight sides alternated with four concave curved sides, the playing area on said game board comprising 128 playing spaces arranged in 16 curved lanes of 8 spaces each, a group of four lanes following approximately the contour of each of said four curved sides of said game board in advancing from one straight side of said game board to the adjacent straight side, and said game board having an octagonal play-directing area at the center of said board, said area changing the 8 central playing spaces into pentagonal shapes, with said octagonal play-directing area containing 8 dotted lines bridging alternate sides of said octagonal play-directing area so as to indicate optional routes taking either a 90 degree turn to the right or a 90 degree turn to the left for those chess pieces permitted to move along a diagonal route that could take them directly toward the center of said game board.

* * * * *